US010770256B1

(12) United States Patent
Seperant

(10) Patent No.: US 10,770,256 B1
(45) Date of Patent: Sep. 8, 2020

(54) FLAT EMITTER

(71) Applicant: Siemens Healthcare GmbH, Erlangen (DE)

(72) Inventor: Florian Seperant, Nuremberg (DE)

(73) Assignee: SIEMENS HEALTHCARE GMBH, Erlangen (DE)

( * ) Notice: Subject to any disclaimer, the term of this patent is extended or adjusted under 35 U.S.C. 154(b) by 0 days.

(21) Appl. No.: 16/814,192

(22) Filed: Mar. 10, 2020

(30) Foreign Application Priority Data

Mar. 18, 2019 (DE) ..... 10 2019 203 630

(51) Int. Cl.
*H01J 35/06* (2006.01)
*H01J 1/18* (2006.01)

(52) U.S. Cl.
CPC ..... *H01J 35/064* (2019.05); *H01J 1/18* (2013.01); *H01J 2235/06* (2013.01)

(58) Field of Classification Search
CPC ..... H01J 35/06; H01J 1/16; H01J 1/18; H01J 2201/2803; H01J 2235/06; H01J 35/064
See application file for complete search history.

(56) References Cited

U.S. PATENT DOCUMENTS 2,653,267 A * 9/1953 McIntosh ..... H01J 1/16 313/245
6,801,599 B1 10/2004 Kautz et al.
7,693,265 B2 4/2010 Hauttmann et al.
9,530,603 B1 12/2016 Kobayashi
2009/0103683 A1* 4/2009 Hauttmann ..... H01J 35/06 378/119
2009/0284121 A1* 11/2009 Lenz ..... H01J 1/14 313/310
2009/0284124 A1* 11/2009 Kutschera ..... H01J 1/14 313/346 DC (Continued)

FOREIGN PATENT DOCUMENTS

DE 2727907 C2 11/1987
DE 19914739 C1 8/2000
DE 10012203 C1 7/2001

(Continued)

OTHER PUBLICATIONS

German Office Action for German Application No. 10 2019 203 630.9 dated Oct. 11, 2019.

(Continued)

*Primary Examiner* — Chih-Cheng Kao
(74) *Attorney, Agent, or Firm* — Harness, Dickey & Pierce, P.L.C.

(57) ABSTRACT

A flat emitter, in an embodiment, includes an emitter surface to emit electrons when a filament current is applied; a first end region including at least one first connection leg; and a second end region including at least one second connection leg. According to an embodiment, at least one connection leg is embodied as a band-type connection leg and is torsioned at an angle in a longitudinal axis. According to an embodiment, the first connection leg and the second connection leg are embodied as band-type connection legs and in each case are torsioned at a definable angle in a longitudinal axis. As a result, a simply constructed flat emitter in terms of design is achieved, with a longer service life and a high level of electron emission.

20 Claims, 2 Drawing Sheets

(56) References Cited

U.S. PATENT DOCUMENTS

| | | | |
|---|---|---|---|
| 2010/0067663 | A1 | 3/2010 | Freudenberger et al. |
| 2014/0239799 | A1 | 8/2014 | Freudenberger |

FOREIGN PATENT DOCUMENTS

| | | | |
|---|---|---|---|
| DE | 102008046721 | B4 | 4/2011 |
| DE | 102010039765 | A1 | 3/2012 |
| EP | 3413331 | A1 | 12/2018 |

OTHER PUBLICATIONS

German National Receipt of Grant for German Application No. 10 2019 203 630.9 dated Dec. 19, 2019.

* cited by examiner

FLAT EMITTER

PRIORITY STATEMENT

The present application hereby claims priority under 35 U.S.C. § 119 to German patent application number DE 102019203630.9 filed Mar. 18, 2019, the entire contents of each of which are hereby incorporated herein by reference.

FIELD

Embodiments of the invention generally relate to a flat emitter.

BACKGROUND

An emitter of this type serves as an electron source and is arranged in a cathode of an X-ray tube. The electrons generated by the flat emitter by resistance heating, e.g. by current feed (application of filament current), are accelerated in the direction of an anode (target). When the electrons collide with the anode they are braked, wherein X-ray radiation arises, which can be used for example for diagnostic imaging, for therapeutic irradiation, for analytical material examination or for a safety review.

During operation of the X-ray tube a filament current (resistance heating) is applied to the flat emitter, which is preferably made of tungsten, tantalum or rhenium, and it is thereby heated to temperatures of up to 2,600° C., as a result of which electrons can, because of their thermal motion, overcome the characteristic work function of the emitter material and then be available as free electrons. After their thermal emission the electrons are accelerated onto an anode by an electrical potential of approx. 120 kV. When the electrons strike the anode, X-ray radiation is generated in the surface of the anode.

The flat emitter can in each case be mounted rigidly in the cathode head on the two connection legs via which the filament current can be supplied.

The temperatures occurring during operation lead in the case of the flat emitter to relatively strong linear expansions which because of stresses result in elastic and/or plastic deformations, wherein mechanical stresses of between 100 MPa and 200 MPa can occur on the emitter because of the thermal expansion. Plastic deformations can have negative impacts on the geometry of the emitted electron beam, meaning that the geometry of the focal point generated on the anode and consequently the image quality may be correspondingly degraded. In addition, the constant activation and deactivation of the filament current during operation of the X-ray tube results in an alternating fatigue loading of the thermionic emitter, which dramatically reduces the service life of the emitter.

Flat emitters with a rectangular emitter surface are described for example in DE 27 27 907 C2 and DE 10 2008 046 721 B4. A flat emitter with a circular emitter surface is known from DE 199 14 739 C1. In the case of the flat emitters cited the emitter surfaces are in each case electrically contacted in a cathode head via two band-type connection legs. The emitter surface and the two band-type connection legs are embodied integrally in the case of the aforementioned flat emitters and are brought into a 90° position via a bend and fixed rigidly in the cathode head. Because of a certain inherent elasticity of the connection legs, there is a limited elasticity of the suspension of the flat emitter. However, there is a risk that when installing the flat emitter the band-type connection legs are torsioned. In the case of a flat emitter with a rectangular emitter surface the band-type connection legs then lie in line with the expansion direction of the emitter. As a result the rigidity of the band-type connection legs deteriorates.

Furthermore, a flat emitter is disclosed in U.S. Pat. No. 7,693,265 B2 which has rigid rod-shaped connection legs (support rods) welded to its rear side.

U.S. Pat. No. 6,801,599 B1 further describes an emitter with welded-on contact rods, in which a certain amount of flexibility can be achieved when fixing the emitter in the cathode head thanks to long sleeves.

A further flat emitter is known from US 2014/0239799 A1, which comprises a rectangular emitter surface which emits electrons when a filament voltage is applied. On one side of the emitter surface the flat emitter has a first end region and on its other side a second end region. A first connection leg is arranged in the first end region and a second connection leg in the second end region. Both connection legs of the flat emitter have a cylindrical geometry, and are thus embodied as rod-shaped and are fixed to the rear side of the flat emitter by means of a material-fit connection in each case (welded or soldered connection). The connection legs thus form support rods for the emitter surface of the flat emitter. Because of the cylindrical geometry the connection legs are easy to manufacture and during installation are invariable in respect of a torsion about the cylinder axis. The disadvantage of the cylindrical geometry is a high level of rigidity (spring rigidity and torsion rigidity) of the connection in the focus head. If the rigidity is too high an excessive restoring force of the connections arises because of the longitudinal expansion of the flat emitter and may result in damage to the flat emitter.

To prevent thermally conditioned longitudinal expansions of the flat emitter from resulting in an elastic and/or plastic deformation of the flat emitter and thus of the emitter surface, it is known from DE 10 2010 039 765 A1 for a flat emitter to be positioned in a first end region via a fixed bearing and to be restricted to a thermal main expansion plane in a second end region via a sliding bearing. In this solution, which is relatively complex in terms of design, thermal longitudinal expansions of the flat emitter thus do not exert any negative effects on the geometry of the emitted electron beam.

SUMMARY

At least one embodiment is directed to creating a flat emitter which has a simple structure in terms of design, with a longer service life and a high level of electron emission.

At least one embodiment is directed to a flat emitter. Advantageous embodiments of the inventive flat emitter form the subject matter of further claims respectively.

In at least one embodiment, the flat emitter includes an emitter surface which emits electrons when a filament voltage is applied, and a first end region which has at least one first connection leg, as well as a second end region which has at least one second connection leg. According to at least one embodiment of the invention at least one connection leg is embodied as a band-type connection leg and is torsioned at a definable torsion angle in a longitudinal axis. The result of such torsion of the band-type connection leg is a torsioned connection leg.

BRIEF DESCRIPTION OF THE DRAWINGS

A schematically presented example embodiment of the invention is illustrated in greater detail below with reference to the drawing, without however being restricted thereto. In the drawings.

DETAILED DESCRIPTION OF THE EXAMPLE EMBODIMENTS

Figure 1:
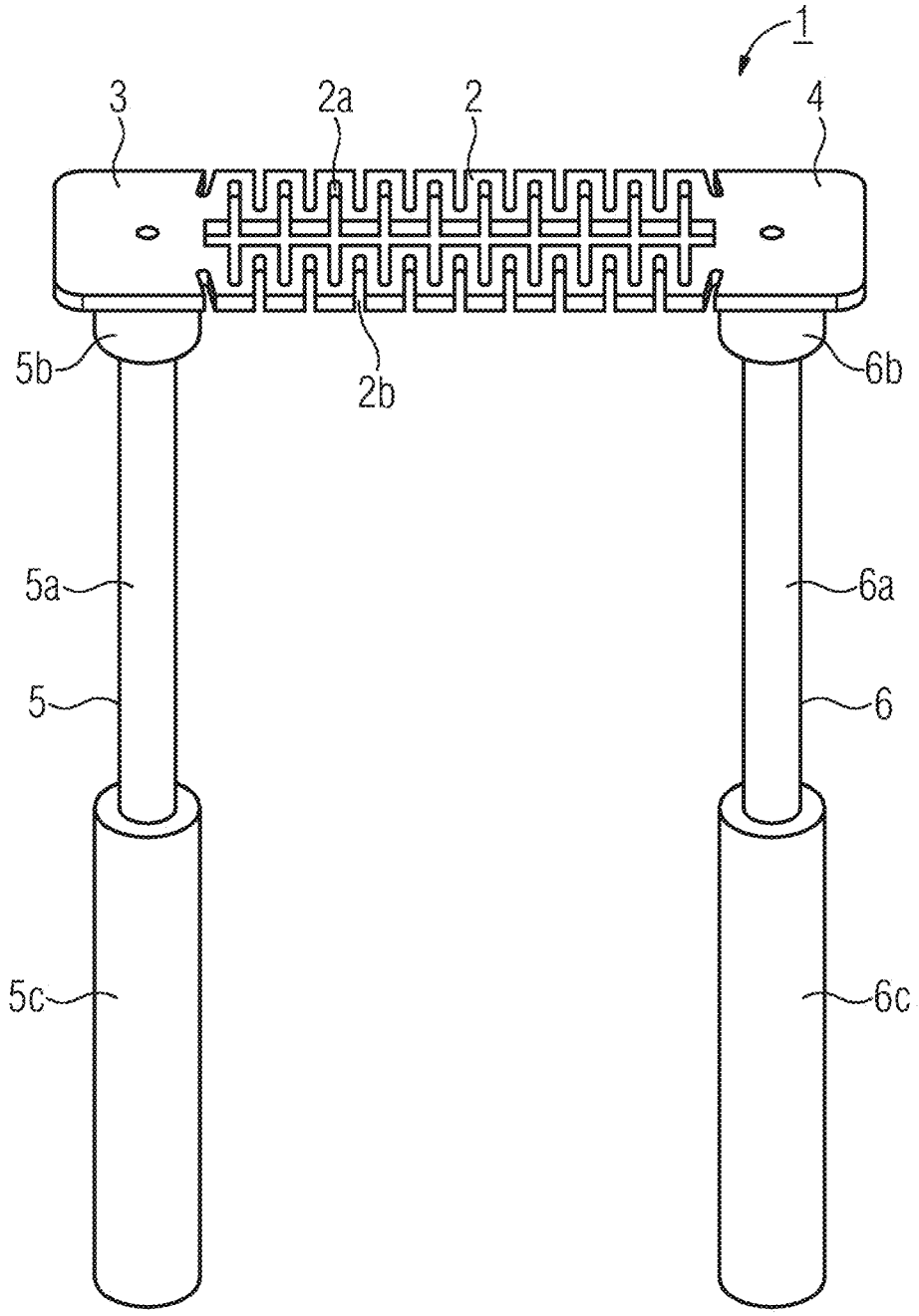
FIG. 1 shows a flat emitter according to the prior art in a perspective view and FIG. 2 shows a flat emitter according to an embodiment of the invention in a perspective view.

The drawings are to be regarded as being schematic representations and elements illustrated in the drawings are not necessarily shown to scale. Rather, the various elements are represented such that their function and general purpose become apparent to a person skilled in the art. Any connection or coupling between functional blocks, devices, components, or other physical or functional units shown in the drawings or described herein may also be implemented by an indirect connection or coupling. A coupling between components may also be established over a wireless connection. Functional blocks may be implemented in hardware, firmware, software, or a combination thereof.

Various example embodiments will now be described more fully with reference to the accompanying drawings in which only some example embodiments are shown. Specific structural and functional details disclosed herein are merely representative for purposes of describing example embodiments. Example embodiments, however, may be embodied in various different forms, and should not be construed as being limited to only the illustrated embodiments. Rather, the illustrated embodiments are provided as examples so that this disclosure will be thorough and complete, and will fully convey the concepts of this disclosure to those skilled in the art. Accordingly, known processes, elements, and techniques, may not be described with respect to some example embodiments. Unless otherwise noted, like reference characters denote like elements throughout the attached drawings and written description, and thus descriptions will not be repeated. The present invention, however, may be embodied in many alternate forms and should not be construed as limited to only the example embodiments set forth herein.

It will be understood that, although the terms first, second, etc. may be used herein to describe various elements, components, regions, layers, and/or sections, these elements, components, regions, layers, and/or sections, should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items. The phrase "at least one of" has the same meaning as "and/or".

Spatially relative terms, such as "beneath," "below," "lower," "under," "above," "upper," and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below," "beneath," or "under," other elements or features would then be oriented "above" the other elements or features. Thus, the example terms "below" and "under" may encompass both an orientation of above and below. The device may be otherwise oriented (rotated 90 degrees or at other orientations) and the spatially relative descriptors used herein interpreted accordingly. In addition, when an element is referred to as being "between" two elements, the element may be the only element between the two elements, or one or more other intervening elements may be present.

Spatial and functional relationships between elements (for example, between modules) are described using various terms, including "connected," "engaged," "interfaced," and "coupled." Unless explicitly described as being "direct," when a relationship between first and second elements is described in the above disclosure, that relationship encompasses a direct relationship where no other intervening elements are present between the first and second elements, and also an indirect relationship where one or more intervening elements are present (either spatially or functionally) between the first and second elements. In contrast, when an element is referred to as being "directly" connected, engaged, interfaced, or coupled to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list. Also, the term "example" is intended to refer to an example or illustration.

When an element is referred to as being "on," "connected to," "coupled to," or "adjacent to," another element, the element may be directly on, connected to, coupled to, or adjacent to, the other element, or one or more other intervening elements may be present. In contrast, when an element is referred to as being "directly on," "directly connected to," "directly coupled to," or "immediately adjacent to," another element there are no intervening elements present.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

Before discussing example embodiments in more detail, it is noted that some example embodiments may be described with reference to acts and symbolic representations of operations (e.g., in the form of flow charts, flow diagrams, data flow diagrams, structure diagrams, block diagrams, etc.) that may be implemented in conjunction with units and/or devices discussed in more detail below. Although discussed in a particularly manner, a function or operation specified in a specific block may be performed differently from the flow specified in a flowchart, flow diagram, etc. For example, functions or operations illustrated as being performed serially in two consecutive blocks may actually be performed simultaneously, or in some cases be performed in reverse order. Although the flowcharts describe the operations as sequential processes, many of the operations may be performed in parallel, concurrently or simultaneously. In addition, the order of operations may be re-arranged. The processes may be terminated when their operations are completed, but may also have additional steps not included in the figure. The processes may correspond to methods, functions, procedures, subroutines, subprograms, etc.

Specific structural and functional details disclosed herein are merely representative for purposes of describing example embodiments of the present invention. This invention may, however, be embodied in many alternate forms and should not be construed as limited to only the embodiments set forth herein.

Units and/or devices according to one or more example embodiments may be implemented using hardware, software, and/or a combination thereof. For example, hardware devices may be implemented using processing circuitry such as, but not limited to, a processor, Central Processing Unit (CPU), a controller, an arithmetic logic unit (ALU), a digital signal processor, a microcomputer, a field programmable gate array (FPGA), a System-on-Chip (SoC), a programmable logic unit, a microprocessor, or any other device capable of responding to and executing instructions in a defined manner. Portions of the example embodiments and corresponding detailed description may be presented in terms of software, or algorithms and symbolic representations of operation on data bits within a computer memory. These descriptions and representations are the ones by which those of ordinary skill in the art effectively convey the substance of their work to others of ordinary skill in the art. An algorithm, as the term is used here, and as it is used generally, is conceived to be a self-consistent sequence of steps leading to a desired result. The steps are those requiring physical manipulations of physical quantities. Usually, though not necessarily, these quantities take the form of optical, electrical, or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise, or as is apparent from the discussion, terms such as "processing" or "computing" or "calculating" or "determining" of "displaying" or the like, refer to the action and processes of a computer system, or similar electronic computing device/hardware, that manipulates and transforms data represented as physical, electronic quantities within the computer system's registers and memories into other data similarly represented as physical quantities within the computer system memories or registers or other such information storage, transmission or display devices.

In this application, including the definitions below, the term 'module' or the term 'controller' may be replaced with the term 'circuit.' The term 'module' may refer to, be part of, or include processor hardware (shared, dedicated, or group) that executes code and memory hardware (shared, dedicated, or group) that stores code executed by the processor hardware.

The module may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a client module.

Software may include a computer program, program code, instructions, or some combination thereof, for independently or collectively instructing or configuring a hardware device to operate as desired. The computer program and/or program code may include program or computer-readable instructions, software components, software modules, data files, data structures, and/or the like, capable of being implemented by one or more hardware devices, such as one or more of the hardware devices mentioned above. Examples of program code include both machine code produced by a compiler and higher level program code that is executed using an interpreter.

For example, when a hardware device is a computer processing device (e.g., a processor, Central Processing Unit (CPU), a controller, an arithmetic logic unit (ALU), a digital signal processor, a microcomputer, a microprocessor, etc.), the computer processing device may be configured to carry out program code by performing arithmetical, logical, and input/output operations, according to the program code. Once the program code is loaded into a computer processing device, the computer processing device may be programmed to perform the program code, thereby transforming the computer processing device into a special purpose computer processing device. In a more specific example, when the program code is loaded into a processor, the processor becomes programmed to perform the program code and operations corresponding thereto, thereby transforming the processor into a special purpose processor.

Software and/or data may be embodied permanently or temporarily in any type of machine, component, physical or virtual equipment, or computer storage medium or device, capable of providing instructions or data to, or being interpreted by, a hardware device. The software also may be distributed over network coupled computer systems so that the software is stored and executed in a distributed fashion. In particular, for example, software and data may be stored by one or more computer readable recording mediums, including the tangible or non-transitory computer-readable storage media discussed herein.

Even further, any of the disclosed methods may be embodied in the form of a program or software. The program or software may be stored on a non-transitory computer readable medium and is adapted to perform any one of the aforementioned methods when run on a computer device (a device including a processor). Thus, the non-transitory, tangible computer readable medium, is adapted to store information and is adapted to interact with a data processing facility or computer device to execute the program of any of the above mentioned embodiments and/or to perform the method of any of the above mentioned embodiments.

Example embodiments may be described with reference to acts and symbolic representations of operations (e.g., in the form of flow charts, flow diagrams, data flow diagrams, structure diagrams, block diagrams, etc.) that may be implemented in conjunction with units and/or devices discussed in more detail below. Although discussed in a particularly manner, a function or operation specified in a specific block may be performed differently from the flow specified in a flowchart, flow diagram, etc. For example, functions or operations illustrated as being performed serially in two consecutive blocks may actually be performed simultaneously, or in some cases be performed in reverse order.

According to one or more example embodiments, computer processing devices may be described as including various functional units that perform various operations and/or functions to increase the clarity of the description. However, computer processing devices are not intended to be limited to these functional units. For example, in one or more example embodiments, the various operations and/or functions of the functional units may be performed by other ones of the functional units. Further, the computer processing devices may perform the operations and/or functions of the various functional units without sub-dividing the operations and/or functions of the computer processing units into these various functional units.

Units and/or devices according to one or more example embodiments may also include one or more storage devices. The one or more storage devices may be tangible or non-transitory computer-readable storage media, such as random access memory (RAM), read only memory (ROM), a permanent mass storage device (such as a disk drive), solid state (e.g., NAND flash) device, and/or any other like data storage mechanism capable of storing and recording data. The one or more storage devices may be configured to store computer programs, program code, instructions, or some combination thereof, for one or more operating systems and/or for implementing the example embodiments described herein. The computer programs, program code, instructions, or some combination thereof, may also be loaded from a separate computer readable storage medium into the one or more storage devices and/or one or more computer processing devices using a drive mechanism. Such separate computer readable storage medium may include a Universal Serial Bus (USB) flash drive, a memory stick, a Blu-ray/DVD/CD-ROM drive, a memory card, and/or other like computer readable storage media. The computer programs, program code, instructions, or some combination thereof, may be loaded into the one or more storage devices and/or the one or more computer processing devices from a remote data storage device via a network interface, rather than via a local computer readable storage medium. Additionally, the computer programs, program code, instructions, or some combination thereof, may be loaded into the one or more storage devices and/or the one or more processors from a remote computing system that is configured to transfer and/or distribute the computer programs, program code, instructions, or some combination thereof, over a network. The remote computing system may transfer and/or distribute the computer programs, program code, instructions, or some combination thereof, via a wired interface, an air interface, and/or any other like medium.

The one or more hardware devices, the one or more storage devices, and/or the computer programs, program code, instructions, or some combination thereof, may be specially designed and constructed for the purposes of the example embodiments, or they may be known devices that are altered and/or modified for the purposes of example embodiments.

A hardware device, such as a computer processing device, may run an operating system (OS) and one or more software applications that run on the OS. The computer processing device also may access, store, manipulate, process, and create data in response to execution of the software. For simplicity, one or more example embodiments may be exemplified as a computer processing device or processor; however, one skilled in the art will appreciate that a hardware device may include multiple processing elements or processors and multiple types of processing elements or processors. For example, a hardware device may include multiple processors or a processor and a controller. In addition, other processing configurations are possible, such as parallel processors.

The computer programs include processor-executable instructions that are stored on at least one non-transitory computer-readable medium (memory). The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc. As such, the one or more processors may be configured to execute the processor executable instructions.

The computer programs may include: (i) descriptive text to be parsed, such as HTML (hypertext markup language) or XML (extensible markup language), (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C#, Objective-C, Haskell, Go, SQL, R, Lisp, Java®, Fortran, Perl, Pascal, Curl, OCaml, Javascript®, HTML5, Ada, ASP (active server pages), PHP, Scala, Eiffel, Smalltalk, Erlang, Ruby, Flash®, Visual Basic®, Lua, and Python®.

Further, at least one embodiment of the invention relates to the non-transitory computer-readable storage medium including electronically readable control information (processor executable instructions) stored thereon, configured in such that when the storage medium is used in a controller of a device, at least one embodiment of the method may be carried out.

The computer readable medium or storage medium may be a built-in medium installed inside a computer device main body or a removable medium arranged so that it can be separated from the computer device main body. The term computer-readable medium, as used herein, does not encompass transitory electrical or electromagnetic signals propagating through a medium (such as on a carrier wave); the term computer-readable medium is therefore considered tangible and non-transitory. Non-limiting examples of the non-transitory computer-readable medium include, but are not limited to, rewriteable non-volatile memory devices (including, for example flash memory devices, erasable programmable read-only memory devices, or a mask read-only memory devices); volatile memory devices (including, for example static random access memory devices or a dynamic random access memory devices); magnetic storage media (including, for example an analog or digital magnetic tape or a hard disk drive); and optical storage media (including, for example a CD, a DVD, or a Blu-ray Disc). Examples of the media with a built-in rewriteable non-volatile memory, include but are not limited to memory cards; and media with a built-in ROM, including but not limited to ROM cassettes; etc. Furthermore, various information regarding stored images, for example, property information, may be stored in any other form, or it may be provided in other ways.

The term code, as used above, may include software, firmware, and/or microcode, and may refer to programs, routines, functions, classes, data structures, and/or objects. Shared processor hardware encompasses a single microprocessor that executes some or all code from multiple modules. Group processor hardware encompasses a microprocessor that, in combination with additional microprocessors, executes some or all code from one or more modules. References to multiple microprocessors encompass multiple microprocessors on discrete dies, multiple microprocessors on a single die, multiple cores of a single microprocessor, multiple threads of a single microprocessor, or a combination of the above.

Shared memory hardware encompasses a single memory device that stores some or all code from multiple modules. Group memory hardware encompasses a memory device that, in combination with other memory devices, stores some or all code from one or more modules.

The term memory hardware is a subset of the term computer-readable medium. The term computer-readable medium, as used herein, does not encompass transitory electrical or electromagnetic signals propagating through a medium (such as on a carrier wave); the term computer-readable medium is therefore considered tangible and non-transitory. Non-limiting examples of the non-transitory computer-readable medium include, but are not limited to, rewriteable non-volatile memory devices (including, for example flash memory devices, erasable programmable read-only memory devices, or a mask read-only memory devices); volatile memory devices (including, for example static random access memory devices or a dynamic random access memory devices); magnetic storage media (including, for example an analog or digital magnetic tape or a hard disk drive); and optical storage media (including, for example a CD, a DVD, or a Blu-ray Disc). Examples of the media with a built-in rewriteable non-volatile memory, include but are not limited to memory cards; and media with a built-in ROM, including but not limited to ROM cassettes; etc. Furthermore, various information regarding stored images, for example, property information, may be stored in any other form, or it may be provided in other ways.

The apparatuses and methods described in this application may be partially or fully implemented by a special purpose computer created by configuring a general purpose computer to execute one or more particular functions embodied in computer programs. The functional blocks and flowchart elements described above serve as software specifications, which can be translated into the computer programs by the routine work of a skilled technician or programmer.

Although described with reference to specific examples and drawings, modifications, additions and substitutions of example embodiments may be variously made according to the description by those of ordinary skill in the art. For example, the described techniques may be performed in an order different with that of the methods described, and/or components such as the described system, architecture, devices, circuit, and the like, may be connected or combined to be different from the above-described methods, or results may be appropriately achieved by other components or equivalents.

In at least one embodiment, the flat emitter includes an emitter surface which emits electrons when a filament voltage is applied, and a first end region which has at least one first connection leg, as well as a second end region which has at least one second connection leg. According to at least one embodiment of the invention at least one connection leg is embodied as a band-type connection leg and is torsioned at a definable torsion angle in a longitudinal axis. The result of such torsion of the band-type connection leg is a torsioned connection leg.

According to a particularly advantageous embodiment, both the first connection leg and the second connection leg are preferably embodied as band-type connection legs and are each torsioned at a definable angle in a longitudinal axis.

For the connection leg of the flat emitter the term "band-type" means a rectangular cross-section with significantly larger dimensions in the longitudinal direction and in the transverse direction than the material thickness.

Because of the band-type embodiment of the connection leg(s) both the spring rigidity and the torsion rigidity are significantly less in the flat emitters known from the prior art. If the band-type connection leg is torsioned when the flat emitter is installed and then lies in line with the expansion direction of the flat emitter, the rigidity of the band-type connection leg deteriorates.

Thanks to at least one embodiment of the inventive solution, namely by torsioning the connection leg along its longitudinal axis at a definable angle, an undesired torsion, which can result in a deterioration in the rigidity, can be reliably prevented. The rigidity of the torsioned connection leg(s) is robust compared to a rotation of the flat emitter on installation into the focus head. Thanks to the realization of at least one embodiment, a longer service life is measured along with constantly high electron emission are obtained for such a flat emitter.

In at least one embodiment of the inventive solution, the thermally conditioned longitudinal expansions of the flat emitter are at least partially absorbed via at least one of the two connection legs. The stresses resulting from the longitudinal expansion are thus reduced thanks to a less rigid connection. As a result the constant activation and deactivation of the filament current during the operation of the X-ray tube results only in a reduced mechanical alternating fatigue loading of the flat emitter(s), as a result of which the service life of the emitter is increased. An X-ray tube with such a flat emitter thus has a correspondingly longer service life.

Because of the significantly reduced mechanical load on the emitter surface even at a high emitter temperature, which prevents the formation of cracks in the emitter structure, a high electron emission can also be guaranteed over a relatively long period.

In the context of at least one embodiment of the invention a plurality of first and second band-type connection legs can also be provided. Thus it is for example possible for the first end region to have one or two first connection legs and for one or two second connection legs to be arranged in the second end region.

According to another embodiment, at least one band-type connecting leg is connected with a material fit via a connection element to the end region of the flat emitter.

In a likewise advantageous embodiment, at least one band-type connection leg is electrically conductively contacted in a cathode of an X-ray tube via a connection element.

In a particularly preferred and therefore advantageous embodiment, the measures of embodiments are combined with one another. In this embodiment at least one band-type connection leg is therefore connected with a material fit via a first connection element to the end region of the flat emitter and is electrically conductively contacted in a cathode of an X-ray tube via a second connection element.

According to an embodiment which is advantageous in terms of manufacturing technology, the connection elements are embodied as cylindrical. The cross-section of the cylindrical connection elements can here be selected in accordance with the design conditions. Thus for example rectangular, triangular, oval or round cross-sections can be realized. According to present knowledge a round cross-section represents the preferred variant.

Although in the context of embodiments of the invention, advantages are achieved in the realization of the torsion with at least one band-type connection leg, all connection legs are preferably embodied as band-type connection legs torsioned at a definable torsion angle in each case in the longitudinal axis.

The band-type connection legs are for example torsioned in the longitudinal axis at a torsion angle of 180° or at a torsion angle of 360°. Thus the torsioned connection legs of the flat emitter are arranged parallel to one another in the region of the contacting in the cathode head. In addition, in the case of a rectangular emitter surface the ends of the torsioned connection legs run parallel to the transverse edges of the emitter surface. Depending on the design conditions, other torsion angles, e.g. 270°, may also be advantageous in the context of the invention. In addition, the torsion angles for the connection legs need not necessarily be the same size. Thus it is also possible to provide different torsion angles for the band-type connection legs of a flat emitter.

According to a further advantageous embodiment, at least one connection leg (the first connection leg and/or the second connection leg) are integrally connected to an end region in a manner which is advantageous in terms of manufacturing technology.

Alternatively to an integral embodiment, at least one connection leg (the first connection leg and/or the second connection leg) can be connected to an end region with a material fit.

Preferred material-fit connections between end region and connection leg are e.g. connections using welding or hard-soldering.

According to a further preferred embodiment, the first connection leg is welded on in the first end region and the second connection leg in the second end region. As a result, materials can advantageously be used for the two connection legs on the one hand and for the emitter surface on the other hand which are optimized in respect of electron emission, thermal load capacity and elasticity.

A likewise preferred embodiment is characterized in that the first connection leg in the first end region and the second connection leg in the second end region are connected to one another by hard-soldering. In this embodiment too, which represents an alternative to a welded connection, an optimum choice of material for the respective connection leg and for the emitter surface is advantageously possible.

A flat emitter designated by 1 in FIG. 1 comprises a rectangularly embodied emitter surface 2 which emits electrons when a filament voltage is applied.

The emitter surface 2 has recesses 2*a* and 2*b* which are arranged alternately from two opposing sides and transverse to the longitudinal direction and parallel to one another.

The flat emitter 1 has a first end region 3 at a first end face of the emitter surface 2 and a second end region 4 at a second end face.

A first connection leg 5 is arranged in the first end region 3 and a second connection leg 6 in the second end region 4.

Both the first connection leg 5 and the second connection leg 6 have a circular cylindrical cross-section, are thus respectively embodied in the form of round rods, and are fixed in each case to the rear side of the flat emitter 1 by means of a material-fit connection (welded or soldered connection). The connection legs 5 and 6 thus form support rods for the emitter surface 2 of the flat emitter 1. Because of the cylindrical geometry the support rods (connection legs) 5, 6 are easy to manufacture and on installation are invariable in respect of a torsion about the cylinder axis. The disadvantage of the cylindrical geometry however is a high level of rigidity (spring rigidity and torsion rigidity) of the connection in a focus head. Since the connection of a flat emitter in a focus head is known, this is not illustrated in FIG. 1.

As shown in FIG. 1, the first connection leg 5, which is embodied as a support rod 5, has a taper 5*a* extending in the longitudinal direction. The second connection leg 6, which identically to the first connection leg 5 is again embodied as a support rod, likewise has a taper 6*a* extending in the longitudinal direction. In both cases a head part 5*b* or 6*b* arises as a result above the taper 5*a* or 6*a* and a foot part 5*c* or 6*c* below the taper 5*a* or 6*a*. Thanks to the tapers 5*a* and 6*a* the spring constants of the support rods 5 and 6 decrease in each case.

The material-fit connection (welded connection, hard-soldered connection) between the first end region 3 and the first support rod 5 takes place via the head part 5*a*. Similarly, the second support rod 6 is connected to the second end region 4 via the head part 6*a*.

The foot part 5*c* of the first connection leg 5 and the foot part 6*c* of the second connection leg 6 each serve to mount the flat emitter 1 in a cathode.

In the case of the known flat emitter the first connection leg 5 and the second connection leg 6 also take on, in addition to the mechanical function (mounting in the cathode), the electrical function (supply of the filament current).

Despite the tapers 5*a* and 6*a*, because of which the spring constants of the support rods 5 and 6 are decreased, there is a risk in the case of the flat emitter 1 illustrated in FIG. 1 that because of the rigidity at high thermal and/or mechanical loads over a lengthy period a thermo-mechanical fatigue of the material may occur. Such a material fatigue may result in irreversible damage to the flat emitter.

Figure 2:
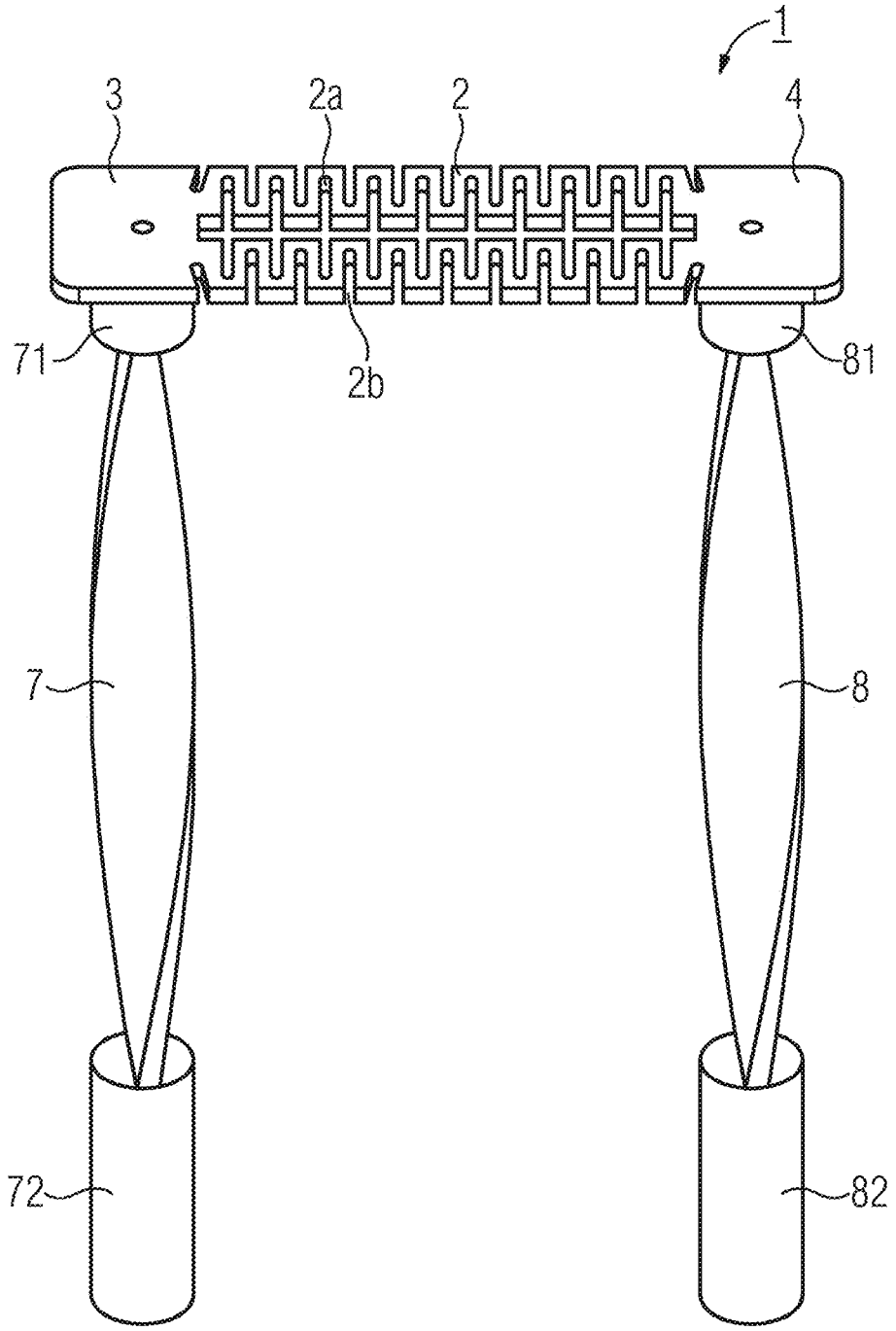

The embodiment illustrated in FIG. 2 of an inventive flat emitter 1 likewise comprises an emitter surface 2 which emits electrons when a filament current is applied.

The emitter surface 2 has recesses 2*a* and 2*b* which are arranged alternately from two opposing sides and transverse to the longitudinal direction and parallel to one another.

The flat emitter 1 has a first end region 3 at a first end face of the emitter surface 2 and a second end region 4 at a second end face.

A first connection leg 7 is arranged in the first end region 3 and a second connection leg 8 in the second end region 4.

According to an embodiment of the invention, at least one connection leg 7 or 8 is embodied as a band-type connection leg 7 or 8 and is torsioned at a definable torsion angle in a longitudinal axis.

In the example embodiment shown of the inventive flat emitter the first connection leg 7 and the second connection leg 8 are embodied as band-type connection legs and are in each case torsioned at a definable torsion angle in a longitudinal axis.

The definable torsion angle for the first connection leg 7 and for the second connection leg 8 is 180° in each case.

In the embodiment shown in FIG. 2 of the inventive emitter 1 both band-type connection legs 7 and 8 are connected to the flat emitter 1 via connection elements 71 and 81 with a material fit.

In the example embodiment illustrated the first band-type connection leg 7 is connected with a material fit to the first end region 3 of the flat emitter 1 via a first cylindrically embodied connection element 71 and is electrically conductively contacted in a cathode (not shown) of an X-ray tube via a second cylindrically embodied connection element 72.

Furthermore, in the example embodiment shown in FIG. 2 the second band-type connection leg 8 is likewise connected with a material fit to the second end region 4 of the flat emitter 1 via a first cylindrically embodied connection element 81 and is electrically conductively contacted in a cathode (not shown) of an X-ray tube via a second cylindrically embodied connection element 82.

As the band-type connection legs 7 and 8 have reduced spring constants and thus lower rigidities, they exert—in contrast to massive, static support rods—less load on the expanding flat emitter 1. It is thus possible for the heated flat emitter 1 to have more freedom of movement in its thermally conditioned expansion. As a result, cracks in the emitter surface 2, which reduce the service life of the flat emitter 1, are significantly reduced.

Although the invention is illustrated and described in more detail by the preferred example embodiment, the invention is not restricted by the example embodiment shown in the drawing. Instead, other variants of the inventive solution can also be derived herefrom by the person skilled in the art, without herewith departing from the underlying inventive idea.

Thus it is e.g. possible for a flat emitter to also have more than two connection legs according to the invention and the advantageous embodiments thereof. In principle it is thus possible, even in the case of known cathodes, to replace an existing flat emitter by an inventive flat emitter. Even in the case of larger flat emitters that have more than two connection legs, all connection legs can be embodied in accordance with the disclosed solutions.

As is apparent from the description of the illustrated example embodiment, the inventive solution offers a more simply constructed flat emitter in terms of design compared to the presently known solutions, with a high level of electron emission in combination with a longer service life.

The patent claims of the application are formulation proposals without prejudice for obtaining more extensive patent protection. The applicant reserves the right to claim even further combinations of features previously disclosed only in the description and/or drawings.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims. Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

None of the elements recited in the claims are intended to be a means-plus-function element within the meaning of 35 U.S.C. § 112(f) unless an element is expressly recited using the phrase "means for" or, in the case of a method claim, using the phrases "operation for" or "step for."

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A flat emitter, comprising:

an emitter surface, to emit electrons upon a filament voltage being applied;

a first end region, including at least one first connection leg; and a second end region, including at least one second connection leg, at least one of the at least one first connection leg and the at least one second connection leg being embodied as a band-type connection leg and being torsioned at a definable torsion angle in a longitudinal axis.

2. The flat emitter of claim 1, wherein each of the at least one first connection leg and the at least one second connection leg are embodied as band-type connection legs and each are torsioned at the definable torsion angle in the longitudinal axis.

3. The flat emitter of claim 2, wherein at least one of the band-type connection legs is connected to the end region of the flat emitter via a connection element with a material fit.

4. The flat emitter of claim 2, wherein at least one of the band-type connection legs is electrically conductively contacted in a cathode of an X-ray tube via a connection element.

5. An X-ray tube comprising the flat emitter of claim 2.

6. The X-ray tube of claim 5, wherein at least one of the band-type connection legs is electrically conductively contacted in a cathode of the X-ray tube via a connection element.

7. The flat emitter of claim 5, wherein at least one of the band-type connection legs is connected to the end region of the X-ray tube via a first connection element with a material fit and is electrically conductively contacted in a cathode of the X-ray tube via a second connection element.

8. The flat emitter of claim 1, wherein the band-type connection leg is connected to the end region of the flat emitter via a connection element with a material fit.

9. The flat emitter of claim 8, wherein the connection element is embodied as cylindrical.

10. The flat emitter of claim 1, wherein the band-type connection leg is electrically conductively contacted in a cathode of an X-ray tube via a connection element.

11. The flat emitter of claim 10, wherein the connection element is embodied as cylindrical.

12. The flat emitter of claim 1, wherein the band-type connection leg is connected to the end region of the flat emitter via a first connection element with a material fit and is electrically conductively contacted in a cathode of an X-ray tube via a second connection element.

13. The flat emitter of claim 1, wherein the definable torsion angle is 180°.

14. The flat emitter of claim 1, wherein the definable torsion angle is 360°.

15. The flat emitter of claim 1, wherein at least one of the at least one first connection leg and the at least one second connection leg is integrally connected to one of the first end region and the second end region.

16. The flat emitter of claim 1, wherein at least one of the at least one first connection leg and the at least one second connection leg is connected to one of the first end region and the second end region with a material fit.

17. The flat emitter of claim 16, wherein the at least one first connection leg is welded on in the first end region and the second connection leg is welded on in the second end region.

18. The flat emitter of claim 16, wherein the at least one the first connection leg, in the first end region, and the at least one second connection leg, in the second end region, are connected to one another by hard-soldering.

19. The flat emitter of claim 1, wherein at least one of the band-type connection legs is connected to the end region of the flat emitter via a first connection element with a material fit and is electrically conductively contacted in a cathode of an X-ray tube via a second connection element.

20. An X-ray tube comprising the flat emitter of claim 1.

* * * * *